US008267841B1

(12) United States Patent
Allison et al.

(10) Patent No.: US 8,267,841 B1
(45) Date of Patent: Sep. 18, 2012

(54) COMBINATION KETTLE BELL AND DUMBBELL

(76) Inventors: Michael R. Allison, Santa Barbara, CA (US); Kasper Allison, Montecito, CA (US)

( * ) Notice: Subject to any disclaimer, the term of this patent is extended or adjusted under 35 U.S.C. 154(b) by 0 days.

(21) Appl. No.: 12/455,158

(22) Filed: Jun. 1, 2009

Related U.S. Application Data

(60) Provisional application No. 61/133,074, filed on Jul. 2, 2008, provisional application No. 60/936,501, filed on Jun. 19, 2007.

(51) Int. Cl.
*A63B 21/06* (2006.01)
*A63B 21/072* (2006.01)
*A63B 21/075* (2006.01)

(52) U.S. Cl. ..... 482/108; 482/93; 482/106

(58) Field of Classification Search ..... 482/44–50, 482/92–94, 97–98, 104–109, 139; 285/23; 269/85, 95, 97; *A63B 21/06, 21/072, 21/075*
See application file for complete search history.

(56) References Cited

U.S. PATENT DOCUMENTS

| | | | | |
|---|---|---|---|---|
| 850,964 | A | 4/1907 | Pelletier et al. | |
| 1,316,683 | A | 9/1919 | Calvert | |
| 1,917,566 | A | 7/1933 | Wood | |
| 1,991,520 | A | 2/1935 | Postl | |
| 2,398,436 | A | 4/1946 | Mason | |
| 2,476,734 | A * | 7/1949 | Jellison | 294/82.32 |
| 3,164,406 | A * | 1/1965 | Barry | 294/88 |
| 4,021,040 | A | 5/1977 | Inoue | |
| 4,192,500 | A | 3/1980 | Crow et al. | |
| 4,351,526 | A | 9/1982 | Schwartz | |
| 4,431,185 | A | 2/1984 | Cisneros | |
| 4,627,618 | A | 12/1986 | Schwartz | |
| 4,659,079 | A | 4/1987 | Blanchard | |
| 4,681,315 | A | 7/1987 | Yang | |
| 4,743,017 | A | 5/1988 | Jaeger | |
| 4,905,988 | A * | 3/1990 | Mooneyhan | 482/50 |
| 5,651,758 | A * | 7/1997 | Cervantes | 482/93 |
| 5,735,779 | A | 4/1998 | Lay | |
| 6,183,400 | B1 * | 2/2001 | Pope | 482/92 |
| 7,052,445 | B2 | 5/2006 | Ekhaus | |

* cited by examiner

*Primary Examiner* — Oren Ginsberg

(74) *Attorney, Agent, or Firm* — Koppel, Patrick, Heybl & Philpott

(57) ABSTRACT

For use with a dumbbell having a transverse connection or connections between two weights, a support structure comprising an elongated handle bar, and means associated with the transverse connection or connections providing releasably connection or connections to the two weights. A preferred clam-shell form of the invention is disclosed.

4 Claims, 8 Drawing Sheets

63
66
64
64a
62
66
64
64a
60
65
61
65
60

FIG. 9.
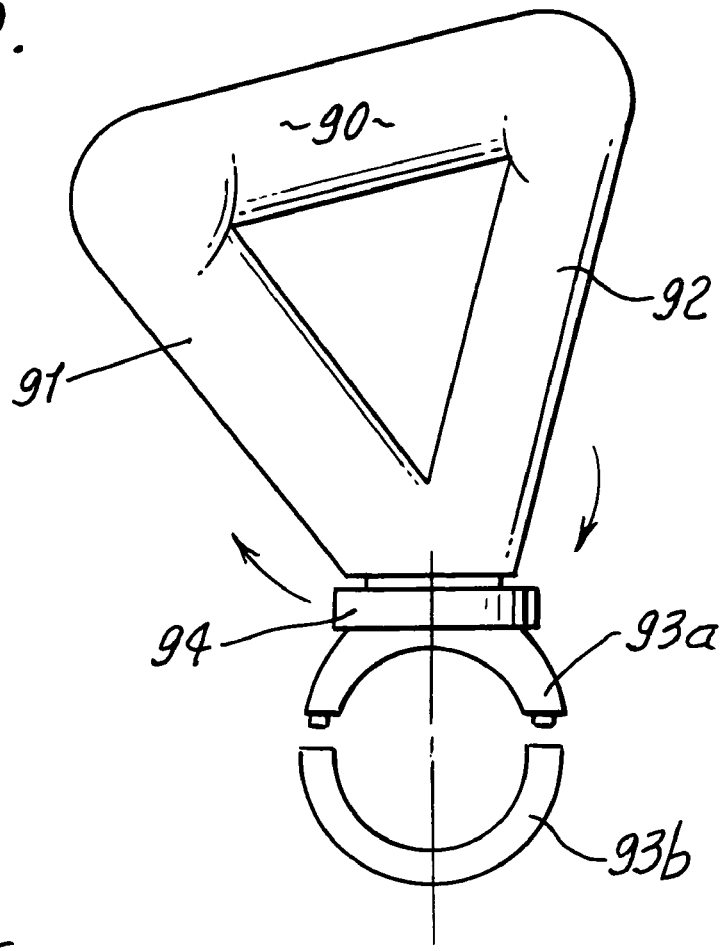
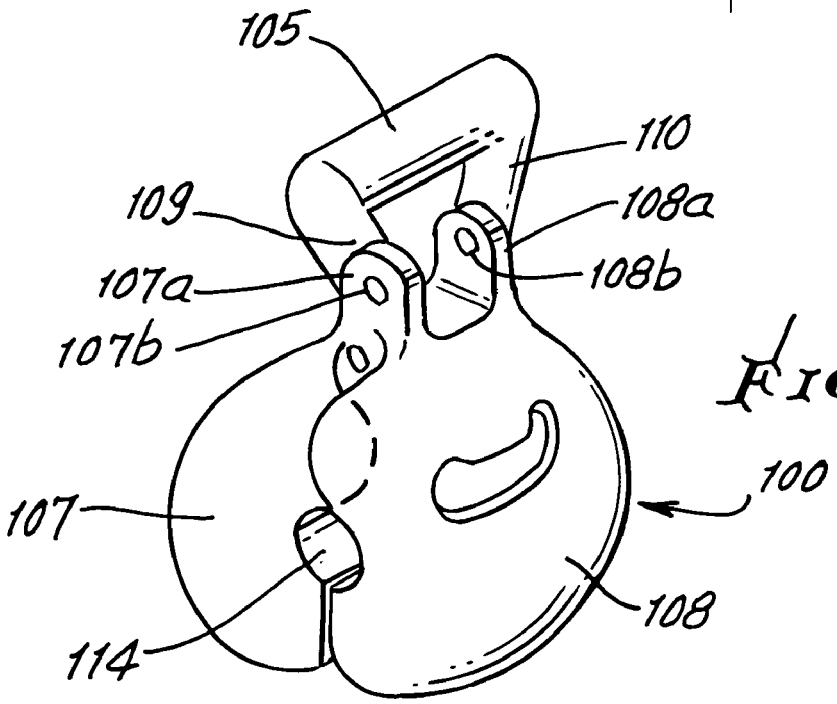
FIG. 10.

COMBINATION KETTLE BELL AND DUMBBELL

This application claims priority from Provisional application Ser. No. 61/133,704, filed Jul. 2, 2008 and Ser. No. 60/936,501, filed Jun. 19, 2007.

BACKGROUND OF THE INVENTION

The present invention relates to handle attachments as disclosed herein to an existing dumbbell, to create a new type of dumbbell with handle structure improving over what is referred to as a kettlebell, (or) a new structural design over dumbbell altogether that will function both as a dumbbell and also what is referred to herein as a kettlebell.

There is need for improvements in handle supported dumbbell structures facilitating their use and enhancement in connection with exercising, and also in design configurations enhancing safety.

SUMMARY OF THE INVENTION

It is a major object of the invention to provide improvements as referred to. Basically, the invention is embodied in a dumbbell having a transverse connection or connections between two weights, and comprising:

a) an elongated handle bar, b) and means associated with said transverse connection or connections providing releasable connection or connections to the two weights.

In one example, which is preferred, the means referred to comprises clam shell members operatively pivotally connected to the bar, the members having two holders that embrace and grasp the connection or connections in response to relative pivoting of one or both of the members. Typically there are cam surfaces on the members to engage the connection or connections to thereby effect the relative pivoting in response to displacement of the members toward the connection or connections. Also, a spring or springs may be provided for urging the two members toward one another, thereby to retain the holders in grasping position relative to the connection or connections, and the spring may comprise a torsion spring acting below the handle to exert torque on the members, tending to close them together.

Another object includes provision of tightenable joints at opposite ends of the bar whereby the angularity of the weights may be adjusted relative to the handle bar.

Yet another object includes provision of an adjustable clasp to which said bar is connected. The clasp may include U-shaped members at least one of which is connected to the bar.

Further, arms may be provided integral with opposite ends of the bar, and also angled toward said U-shaped member. A rotatable connection may be provided between the one U-shaped member and convergent ends of the arms.

An additional object is to provide the handle bar in the form of two elongated sections, with a clasp having two elongated members interconnected by a hinge, and arms respectively connecting one handle section to one of said members, and another handle section to another of said members, whereby the handle sections are pivotably closeable toward one another.

An added object as to provide two clasp members, at least one of which is operatively connected to said handle bar, said two members fitting together and embracing said transverse connection.

These and other objects and advantages of the invention, as well as the details of an illustrative embodiment, will be more fully understood from the following specification and drawings, in which:

DRAWING DESCRIPTION

FIG. 9 is an elevation showing a rotary handle connects to weight holding means;

Figure 12:
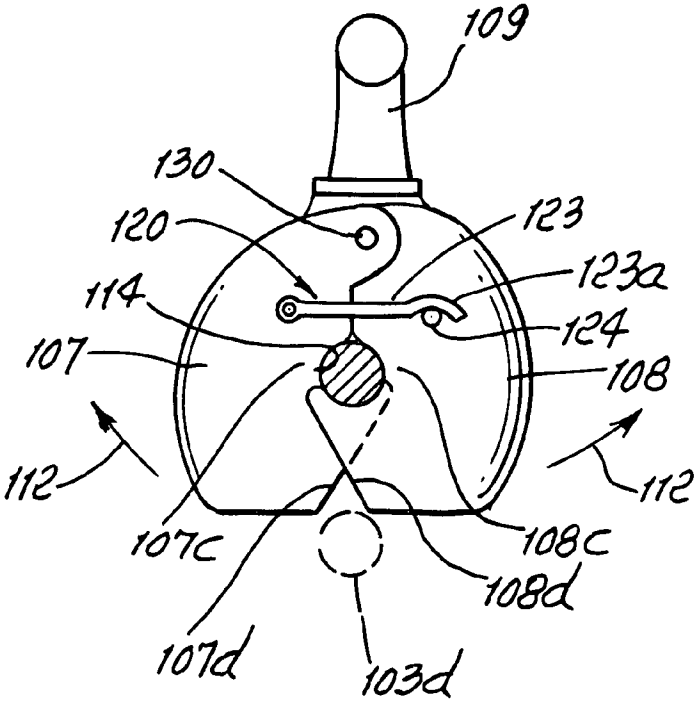
Figure 11:
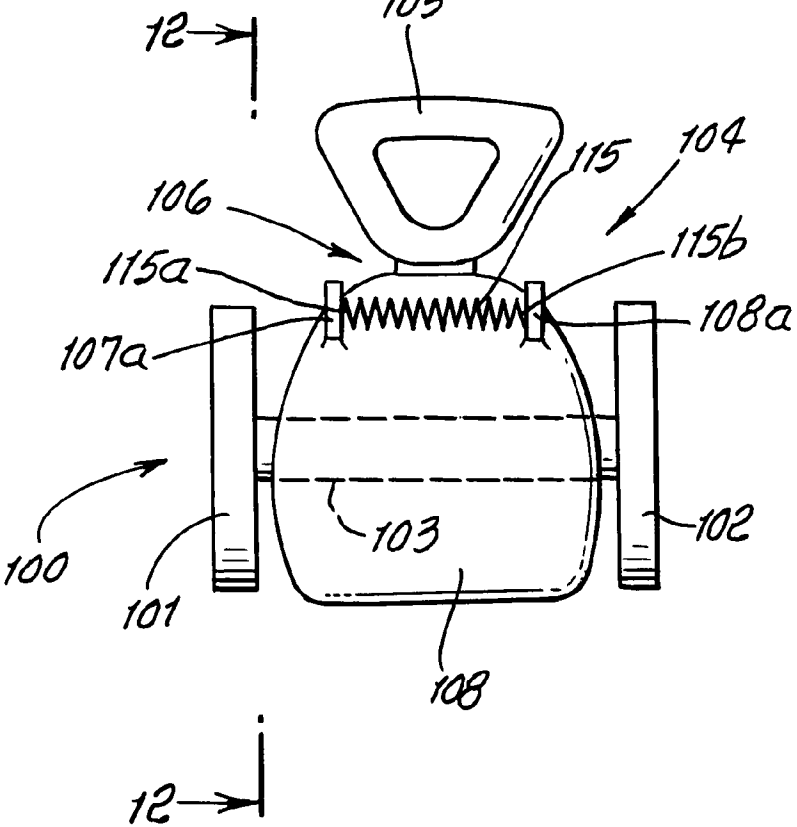

FIG. 10 as a perspective view of a clam-shell type holder connectable to an arm between two weights;

FIG. 11 is a frontal view of the FIG. 10 device; showing a torsion spring; and FIG. 12 is an end view taken on lines 12-12 of FIG. 11.

DETAILED DESCRIPTION

Figure 1:
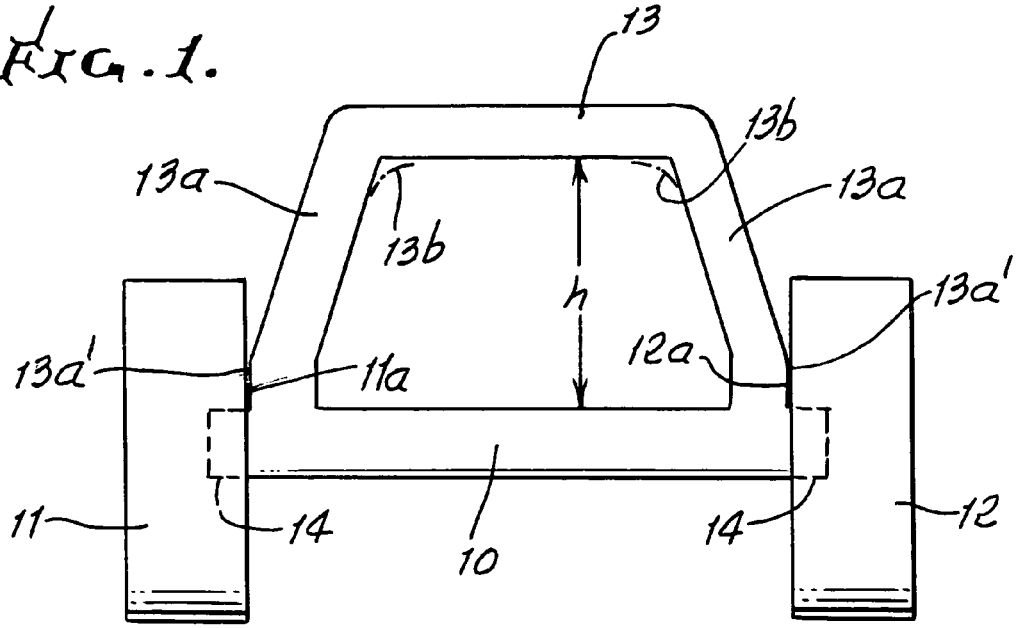
FIGS. 1 and 2 are elevations showing two forms of the invention.

FIG. 1 is a front view of a preferred new design for a dumbbell that will function both as a standard dumbbell, and also as what is commonly referred to as a Kettlebell. The cross sectional shape of the upper handle 13 may be straight, curved, square, rectangular, triangular or of other shape. The width of the handle between divergent arms 13*a* may be sized to accommodate a variety of hand sizes and user applications. The width may be wide enough to accommodate two hands side by side holding the handle simultaneously. The diameter of the handle may be sized to accommodate a variety of manual grip sizes. The height of the handle away from the dumbbell axis may be of height, and substantial, so as to accommodate different uses or applications, as for example hand gripping of either arm 13*a*. Handle and arm corners may then be filleted as at 13*b*. Handle height "h" accommodates such gripping.

The representative FIG. 1 apparatus has a transverse connection or connections 10 between two weights 11 and 12, a transversely elongated handle or bar 13, and means associated with 10 providing releasable connection or connections 14 to the two weights. Arms 13*a* are angled divergently toward 14. Stops 13*a*' on the arms 13*a* position the faces 11*a* and 12*a* of the weights.

Figure 2:
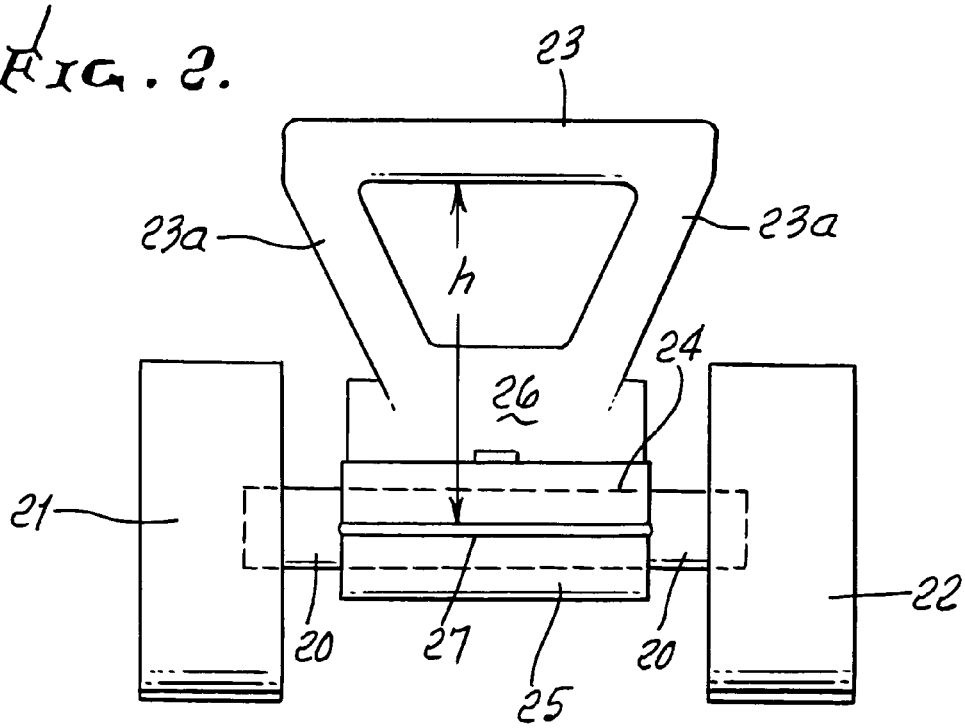

FIG. 2 is a front view of a handle attachment to an existing dumbbell. The handle attachment may be made of metal, plastic, leather, synthetic material or some other strong, lightweight material. The shape of the handle attachment may be straight, curved, square, rectangular, triangular or of some other shape to best match or accommodate to the shape and weight position of the dumbbell being attached to. The transverse width of the handle itself may be such as to accommodate a variety of hand sizes and user applications. The width may be wide enough to accommodate two human hands in side by side position holding the handle simultaneously. The diameter or cross dimensions of the handle is typically such as to accommodate a variety of grip sizes. The height "h" of the handle may be of different heights so as to accommodate different applications, such as gripping of one or both angled arms 23*a*. The representative FIG. 2 apparatus has a transverse connection or connections 20 between two weights 21 and 22; a transversely elongated handle 23 offset from 20 as by height "h", and means including two (upper and lower) clasp members 24 and 25 fitting together and embracing the transverse connection 20. Arms 23*a* are angled convergently toward 24, and connected at 26 to 24. A hinge 27 allows opening and closing of 24 and 25.

Figure 3:
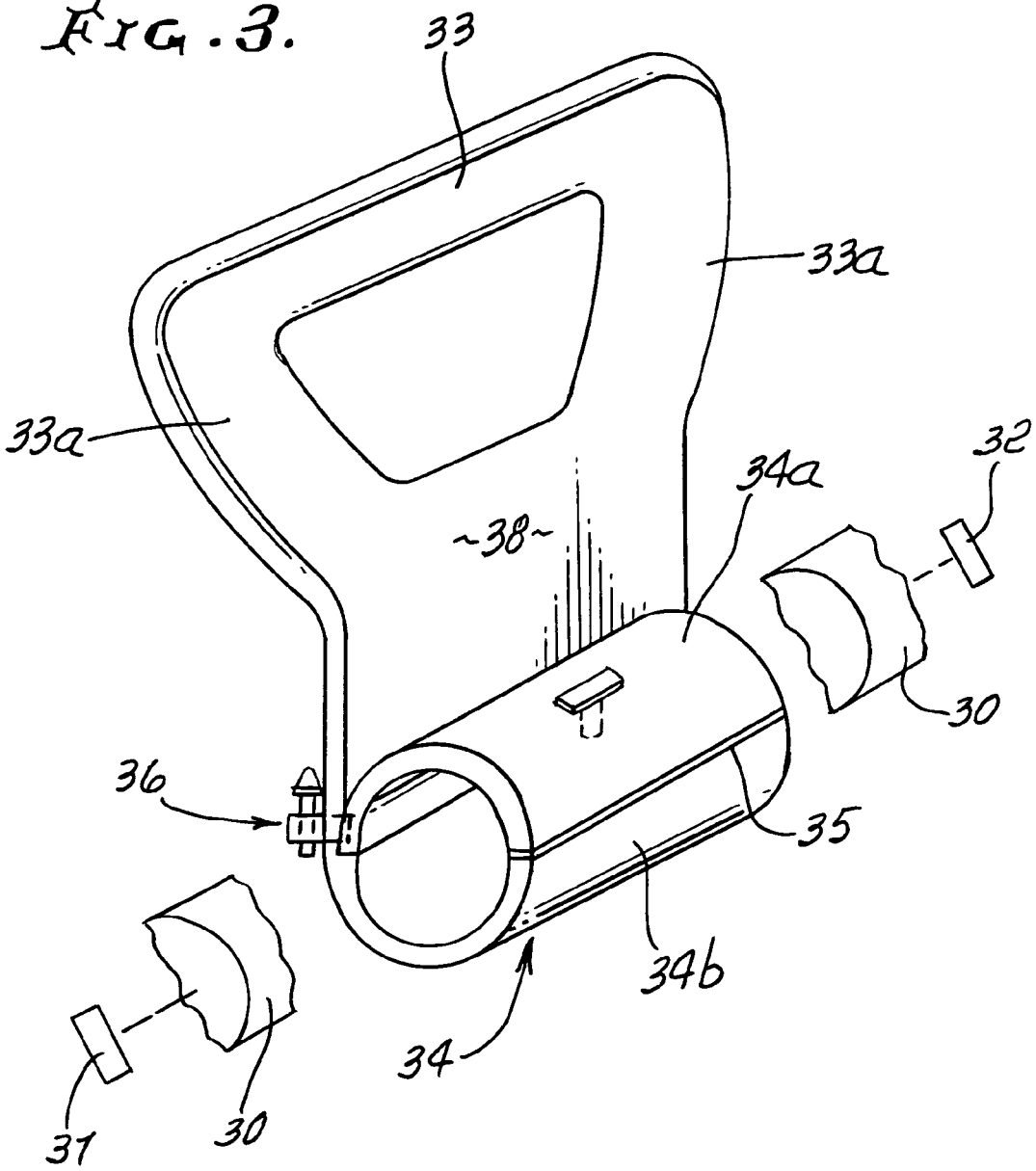
FIG. 3 is a perspective view showing modified apparatus.

FIG. 3 is a perspective view of a modified one-piece handle attachment to an existing dumbbell. This view demonstrates how the handle may easily attach to an existing dumbbell, as by a hinge with a locking/tightening system that wraps around and locks the existing dumbbell handle inside of clasps. This locking system may also squeeze the dumbbell handle, forming a tight grip, or it may permit the dumbbell handle to rotate, depending on the application and size of the dumbbell handle. The transverse width of the hinge/locking system may be such as to accommodate to an existing dumbbell handle. It may incorporate a single hinge/lock or more than one hinge/lock. The locking system may be comprised of a clamp, screw, hook, clasp, push pin, Velcro, strap, buckle, or a combination thereof. The handle unit may be comprised of a single attachment located at the center of the dumbbell bar, or two separate attachments with hinges that attach to the dumbbell at each end of the dumbbell bar. Handle unit designs will typically have safety clasps that help secure the handle to the bar of the dumbbell. Such safety clasps may be made of a secure, high strength material (i.e. Nylon webbing, Velcro, plastic, or metal). The handle, if rotatable, rotates through a pre-established range of motion, for example allowing the handle to rotate 180 degrees, Such rotation would be such as to provide either free rotational movement throughout the complete range of motion, or it would provide specific positions in which to lock the handle, such as 0 degrees, 45 degrees, 90 degrees and 135 degrees. Handle rotation enables the user to perform a wider variety of exercises, with more applications, than either a stand alone dumbbell or kettlebell. FIG. 3 apparatus has a transverse connection or connections 30 between two weights, shown schematically at 31 and 32; a transversely elongated handle or bar 33; and means providing releasable connection or connections to the weights, as via releasable clasp structure 34. That structure includes an upper U-shape member 34*a* integral with 33, via plate 38; and a lower U-shaped member 34*b* hinged at 35 to an end of 34*a*. Members 34*a* is releasably connected at 36 to lower extent of plate 38. Handle 33, and arms 33*a* are angled, for gripping.

Figure 4:
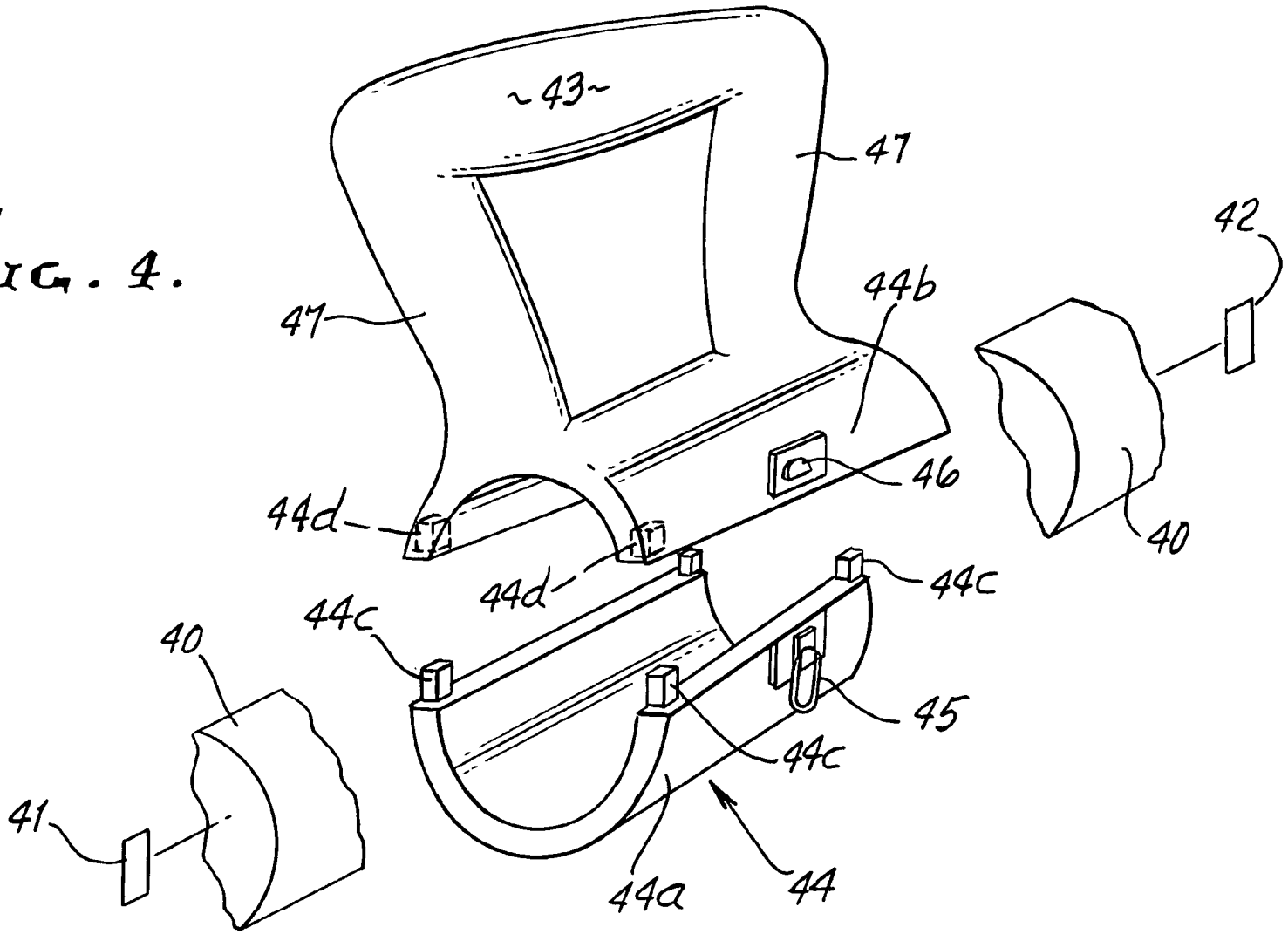
FIGS. 4 and 5 are perspective views showing further modified apparatus.
Figure 5:
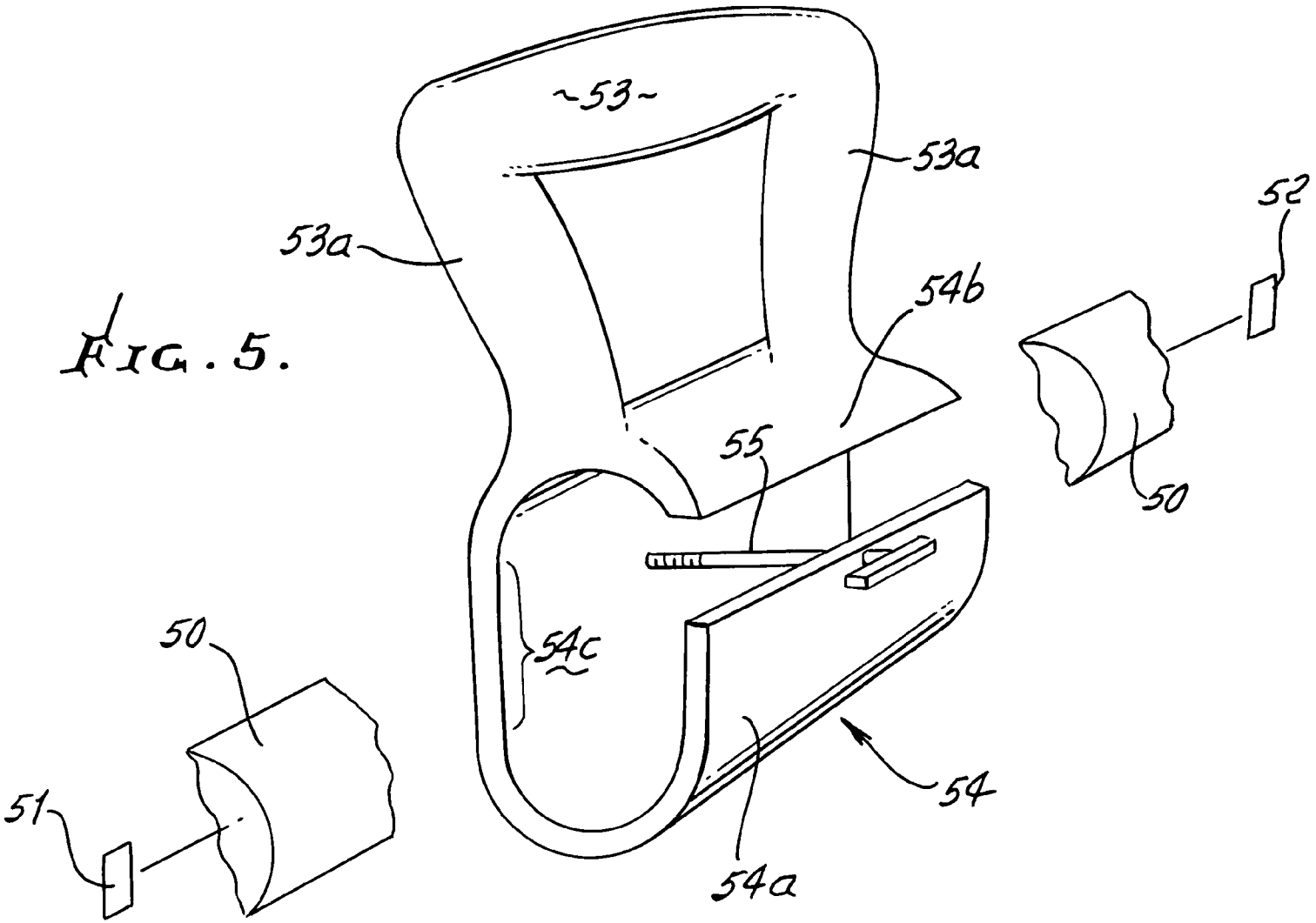
Figure 6:
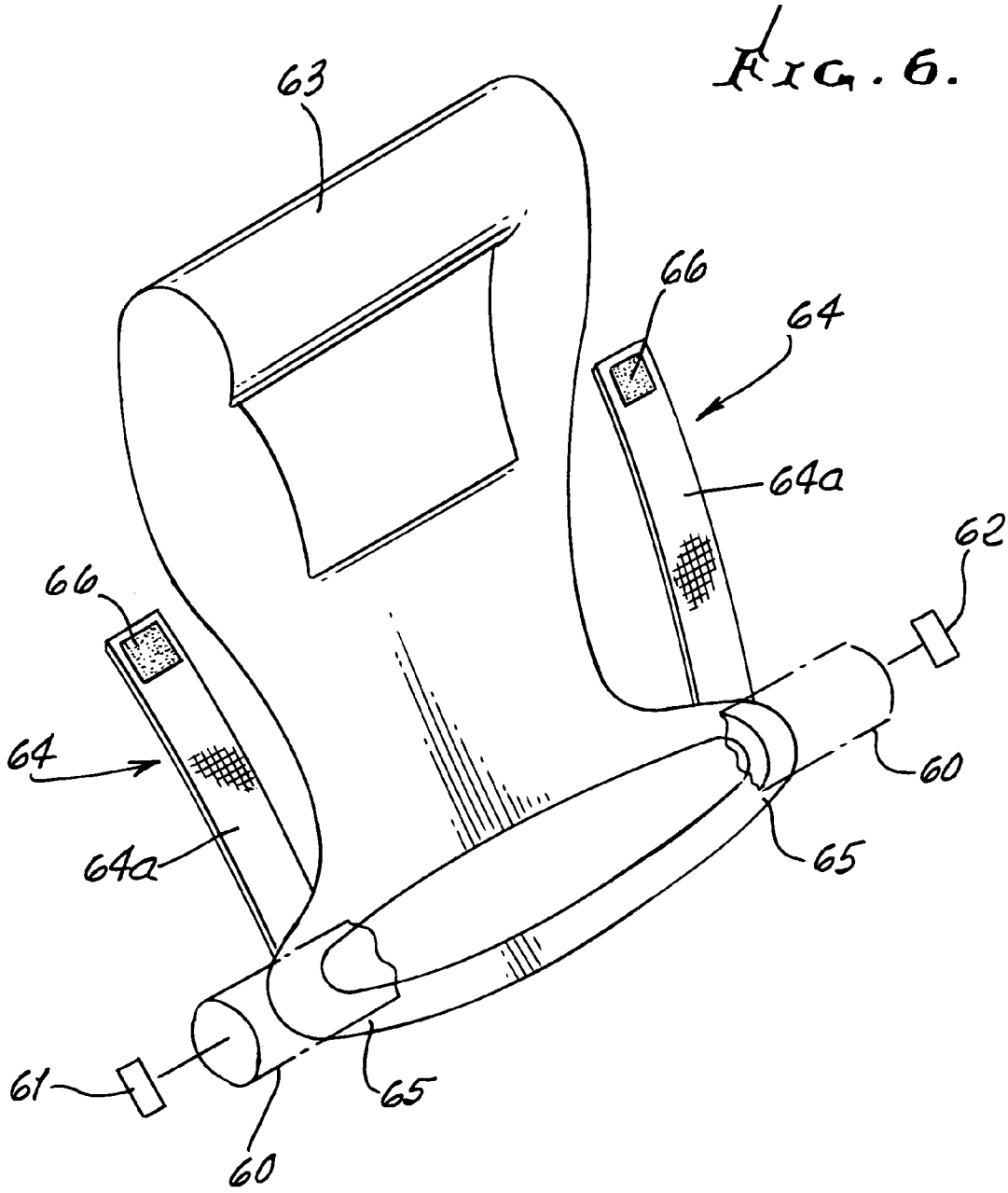
FIG. 6 shows use of clasps on the apparatus.

FIGS. 4, 5 and 6 demonstrate other ways in which the inventive handle attachment may also attach to an existing dumbbell handle. All handle unit designs typically have safety clasps that will help secure the handle to the bar of the dumbbell. These safety clasps may be made of a secure, high strength material (i.e. Nylon webbing, Velcro), plastic, or metal. The handle may also incorporate a rotating configuration allowing the handle to rotate through a pre-established range of motion, such as 180 degrees, and the rotation provides either free rotational movement throughout the complete range of motion, or rotate to specific positions, to lock the handle, such as 0 degrees, 45 degrees, 90 degrees and 135 degrees. The rotating handle enables the user to perform a wider variety of exercises with more applications than either a stand alone dumbbell or kettlebell. The handle attachment may be made of metal, plastic, leather, synthetic material or some other strong, lightweight material. The shape of the handle attachment is such as to best match the shape of the dumbbell being attached to. The transverse width of the handle is such as to accommodate a variety of hand sizes and user applications. Such width accommodates two hands holding the handle simultaneously.

FIG. 4 shows a two piece handle attachment with a push pin locking system. This two piece handle unit snaps together via a push-pin locking system or equivalent means to connect the two pieces. Safety clasps are provided that will help secure the handle to the bar of the dumbbell, and may be made of a safe, secure material (i.e. Nylon webbing, Velcro), plastic, or metal. The handle incorporates a rotating option, allowing the handle to rotate through a pre-established range of motion, such as 180 degrees. Rotation provides either free rotational movement throughout the complete range of motion, or it provides specific positions in which to lock the handle, such as 0 degrees, 45 degrees, 90 degrees and 135 degrees. The rotating handle enables the user to perform a wider variety of exercises with more applications than either a stand alone dumbbell or kettlebell.

The handle attachment may be made of metal, plastic, leather, synthetic material or some other strong, lightweight material. The shape of the handle attachment may be straight, curved, square, rectangular, triangular or of some other shape, to best match the shape of the dumbbell being attached to. The width of the handle itself may be such as to accommodate a variety of hand sizes and user applications, for example to accommodate two hands holding the handle simultaneously. The diameter of the handle may be small, medium, large or extra large to accommodate a variety of grip sizes. The height of the handle may be of different heights so as to accommodate different applications.

The FIG. 4 apparatus has a transverse connection or connections 40 between two weights shown schematically at 41 and 42; a transversely elongated handle or bar 43; and means providing releasable connection or connections to the weights, as via releasable clasp structure 44. The latter includes a lower U-shaped member 44*a*, and an upper U-shaped member 44*b*, connected by push pins 44*c* and recesses 44*d* to member 44*b*. A clasp 45 on 44*a* pivots to connect to retainer 46 on 44*b*, holding 44*a* and 44*b* together. Arms 47 are angled and downwardly convergent to connect 43 to 44*b*. Members 44*a* and 44*b* clamps onto 40. Any of 43 and 47 may be hand gripped during exercise.

The FIG. 5 apparatus is similar to FIG. 4, and has a transverse connector or connectors 50 between two weights shown schematically at 51 and 52; a transversely elongated handle or bar 53; and means providing releasable connection or connections to the weights, as via releasable clasp structure 54. The latter includes a lower U-shaped member 54*a* and an upper U-shaped member 54*b*, integral with arms 53*a* angled from 53 toward 54*b*, as in FIG. 4. Member 54*a* is also integral with 54*b* at region 54*c*. When screw 55 is tightened, 54*a* and 54*b* are clasped to connector 50.

FIG. 6 shows a one piece handle attachment whereby material such as a strap made of Nylon, leather or similar strong but lightweight material wraps around the existing dumbbell handle, and locks back onto the handle structure. The FIG. 6 apparatus has a transverse connection or connections 60 between two weights shown schematically at 61 and 62; a transversely elongated handle or bar 63; and means providing releasable connection or connections to the weights, as via releasable structures 64. Those include straps 64*a* attached to connector positioner 65. The straps releasably extend around 60 and fasten at VELCRO 66 to strap windings.

Figure 7:
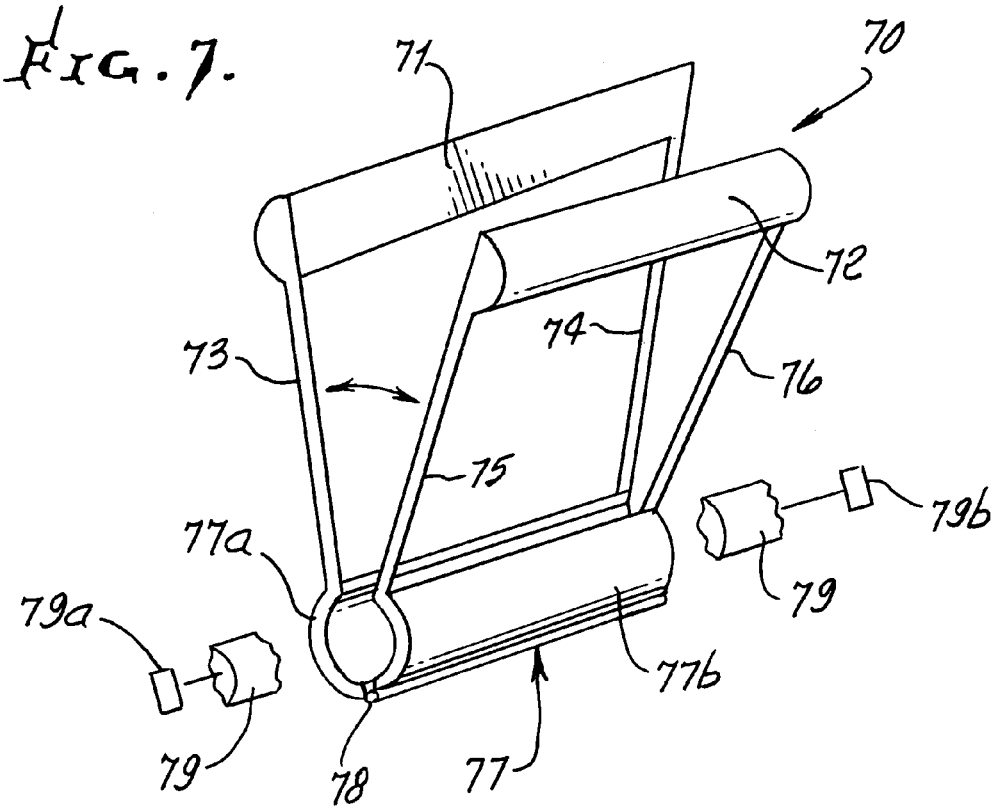
FIG. 7 shows dumbbell holding apparatus having a closable split handle.

FIG. 7 shows a one piece handle attachment whereby two half handles have a hinge along the bottom to allow the attachment to open so as to extend around the existing dumbbell bar, the half handles then locking together to form a single new handle for gripping. The half handles may lock together by a single hinge/lock or more than one hinge/lock.

The locking system may be comprised of a clamp, screw, hook, clasp, push pin, Velcro, strap, buckle, snap-in-place, or a combination thereof.

The FIG. 7 device may have two separate attachment areas to each end of the bar of a dumbbell, or a single clasp attachment, as shown in drawing.

FIG. 7 shows handle 70 with two transversely elongated sections 71 and 72 supported by arms 73, 74, 75 and 76. A clasp 77 has two transversely elongated semi-cylindrical members 77*a* and 77*b* joined to lower ends of the arms as shown. Hinge 78 connects members 77*a* and 77*b* allowing placement of an elongated connection 79 into the space between 77*a* and 77*b*, and subsequent closure of the handle sections 71 and 72 to support connection 79 and weights 49*a* and 79*b* schematically shown as connected to ends of 79.

In the various views, the transverse handles are elongated to have lengths between 6 and 12 inches, allowing optimal two manually handed gripping by a user, for exercise use. The arms connected to the transverse handles have lengths between 6 and 10 inches, typically, and accommodate swinging of the weights.

Figure 8:
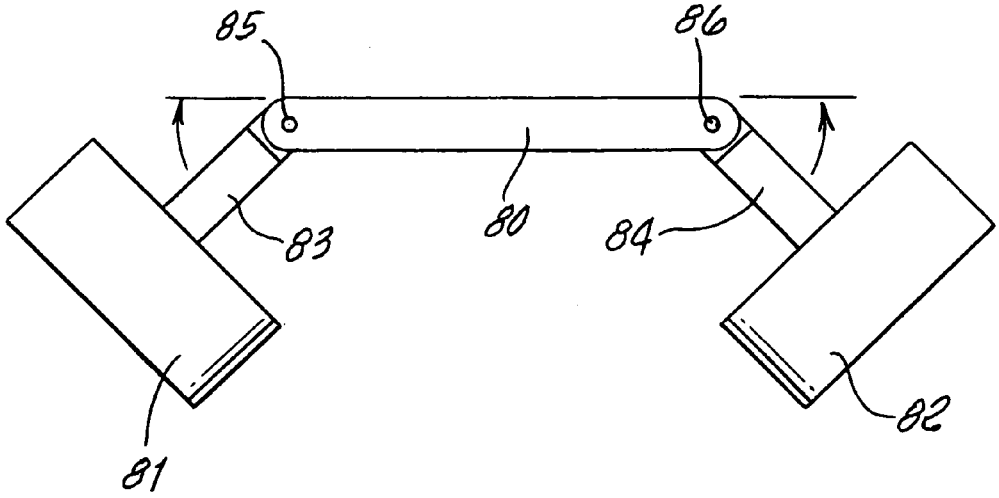
FIG. 8 shows a further modified dumbbell, with pivotable links connected to two weights.

FIG. 8 shows transverse handle 80, weights 81 and 82, and structure including link connections 83 and 84 to the weights, and including adjustable angle and tightenable joints 85 and 86 connected between ends of 80 and 83 and 84.

FIG. 9 shows transverse handle 90, arms 91 and 92, dual U-shaped member clasp structure 93*a* and 93*b* as in FIG. 4, and a rotary connection 94 between 93*a* and lower ends of the arm 91 and 92.

Referring now to FIGS. 10-12 showing a preferred form of the apparatus, a dumbbell is shown at 100, with weights 101 and 102 at opposite ends of connection rod 103. The support structure 104 includes a transversely elongated handle bar 105 supporting means 106 associated with the connection or connections 103 that provides releasable connection to the weights. As shown, such means 106 comprises two clam-shell members 107 and 108 operatively pivotably connected, as at 107*a* and 108*a* to the bar 105, as via angled arms 109 and 110. The lower ends of those arms are pivotally connected to spaced apart lugs 107*b* and 108*b* projecting upwardly from the members 107 and 108.

The members 107 and 108 have two holders 107*c* and 108*c* that embrace and grasp the connection rod 103 in response to relative pivoting of one or both of the members, as about transverse pivot axis 130. When the members pivot away from the rod 103, the rod and the weights are released.

There are angled cam surfaces 107*d* and 108*d* on the two members, to engage rod 103 and effect the described relative pivoting i.e. spreading of the clam-shell members, (see arrows 112) in response to downward displacement of the members toward the rod 103, as in its broken line position 103*d* in FIG. 12. After the rod enters the zone 114 between the members, the latter pivot back toward one another, an shown in FIGS. 10 and 12, to grasp and hold the rod 103, for dumbbell use.

A torsion spring 115 is provided and located to yieldably urge the members toward their positions as seen in FIGS. 10 and 12. That spring is shown as having ends 115*a* and 115*b* attached to the lugs, to resist lug pivoting with the members. The spring locks the members in rod grasping position, as shown in FIGS. 10 and 12. A positive safety lock may be provided, as shown at 120 in FIG. 12, in the form of a link 123 pivoted to member 107, and having a turned end 123*a* that fits down over a pin 124 on member 108.

A slot or handle 126 on member 108 permits easy manual pulling of member 108 away from member 107, disengaging the attachment of the clam-shell members to the dumbbell rod 103.

We claim:

1. For use with a dumbbell having a transverse connection or connections between two weights, a support structure comprising a) an elongated handle bar having a transverse width to accommodate the gripping portion of a hand, said gripping portion comprising portions of at least 2 fingers and a palm, b) and means associated with said transverse connection or connections providing releasably connection or connections to the two weights, when the dumbbell is present, wherein said means comprises two clam-shell members operatively pivotally connected to said bar, said members having two holders that embrace and grasp said connection or connections in response to relative pivoting of one or both of said members, wherein said members enclose at least a majority of said transverse connection or connections while releasably connected, c) further including a safety lock extending between said members to hold them in a connection embracing position and further including a spring or springs urging said members toward one another thereby to retain said holders in grasping position relative to said connection or connections.

2. The structure of claim 1 wherein said bar has a manually graspable length exceeding 6 inches.

3. The structure of claim 1 wherein said means includes pivotable joints.

4. The structure of claim 1 wherein there are cam surfaces on said members to engage said connection or connections to thereby effect said relative pivoting in response to displacement of the members toward said connection or connections.

* * * * *